US009001211B1

(12) United States Patent
Spivey

(10) Patent No.: US 9,001,211 B1
(45) Date of Patent: Apr. 7, 2015

(54) SURVEILLANCE SYSTEM APPARATUS

(76) Inventor: Kervin R. Spivey, Hagerstown, MD (US)

( * ) Notice: Subject to any disclaimer, the term of this patent is extended or adjusted under 35 U.S.C. 154(b) by 465 days.

(21) Appl. No.: 13/158,147

(22) Filed: Jun. 10, 2011

Related U.S. Application Data

(60) Provisional application No. 61/354,043, filed on Jun. 11, 2010.

(51) Int. Cl.
*G08B 13/00* (2006.01)
*G08B 13/196* (2006.01)

(52) U.S. Cl.
CPC ..... *G08B 13/196* (2013.01)

(58) Field of Classification Search
USPC ..... 348/159
See application file for complete search history.

(56) References Cited

U.S. PATENT DOCUMENTS

| | | | | |
|---|---|---|---|---|
| 4,738,583 | A * | 4/1988 | Macconochie et al. | 414/735 |
| 6,396,535 | B1 * | 5/2002 | Waters | 348/159 |
| 2005/0028221 | A1 * | 2/2005 | Liu et al. | 725/133 |
| 2005/0126144 | A1 * | 6/2005 | Koselka et al. | 56/10.2 R |
| 2007/0186671 | A1 * | 8/2007 | Rogers et al. | 73/800 |
| 2007/0236570 | A1 * | 10/2007 | Sun et al. | 348/159 |
| 2011/0134243 | A1 * | 6/2011 | Siann et al. | 348/143 |

* cited by examiner

*Primary Examiner* — Sath V Perungavoor
*Assistant Examiner* — Jeffery Williams
(74) *Attorney, Agent, or Firm* — Perkins Coie LLP

(57) ABSTRACT

A surveillance apparatus including a platform defining a central axis; a plurality of fixed field of view cameras mounted to the platform and equiradially spaced about the central axis. Each camera has a fixed field of view over an angular range of about 90 degrees about the central axis such that the plurality of cameras define a fixed field of view of the area of 360 degrees about the central axis. At least one pivotable camera is preferably mounted to the platform and radially spaced from the central axis providing a mutable view about the central axis. A communications device is coupled to the fixed field and pivotable cameras to provide a continuous fixed field view of the area and a mutable view of the area.

12 Claims, 3 Drawing Sheets

SURVEILLANCE SYSTEM APPARATUS

PRIORITY DATA AND INCORPORATION BY REFERENCE

The instant application claims the benefit of priority to U.S. Provisional Patent Application No. 61/354,043, filed Jun. 11, 2010, entitled, "Wireless Industrial Surveillance System Apparatus Mount," and which is incorporated by reference in its entirety.

TECHNICAL FIELD

The present invention relates generally to a mounting apparatus arrangement for surveillance equipment preferably for use in wireless industrial surveillance.

BACKGROUND OF THE INVENTION

One type of camera used in known surveillance systems is a traditional Pan Tilt and Zoom (PTZ) camera, i.e., a camera having a field of view capable of pivot or rotation about at least two axes of rotation along with zoom capability. However, surveillance systems that employ a mounting arrangement with only a PTZ camera to view and monitor infractions within the area under surveillance may leave portions of the area unmonitored, i.e., dead space, when the camera pivots, tilts or zooms to one particular portion of the surveillance area because the camera is able to look at only one location at a time.

SUMMARY OF THE INVENTION

One preferred embodiment of the mounting arrangement provides a camera array pole mount that can provide one 360 degree fixed camera and one Pan Tilt and Zoom (PTZ) thermal camera zooming on a detected object while not losing the 360 degree fixed camera fields of view. For example, mounted cameras, radios, and PTZ cameras can be mounted on one platform, which can allow continuous fixed 360 degree of surveillance, while the PTZ can monitor and zoom on a mutable location and not lose the fixed fields of view.

Another preferred embodiment provides an apparatus that includes a mount disposed to be attached to a surface; a first camera attached to the mount and configured to provide a fixed view of a designated area; at least a second camera attached to the mount and disposed to provide a mutable view; and one or more sensors attached to the mount and disposed to make visual and audio recordings of the fixed and mutable views to continuously wirelessly stream the views.

In yet another preferred embodiment, an apparatus is provided for surveillance of an area. The apparatus preferably includes a platform defining a central axis; a plurality of fixed field of view cameras mounted to the platform and equiradially spaced about the central axis. Each camera having a fixed field of view over an angular range of about 90 degrees about the central axis such that the plurality of cameras define a fixed field of view of the area of 360 degrees about the central axis. At least one pivotable camera is preferably mounted to the platform and radially spaced from the central axis to provide mutable views about the central axis. A communications device is coupled to the fixed field and pivotable cameras to provide a continuous fixed field view of the area and a mutable view of the area.

In another preferred embodiment of the present invention, a method of surveillance preferably includes obtaining a continuous fixed field of view of the area about a central axis of surveillance platform; and obtaining a mutable view of the area about the central axis of the platform. The method further includes simultaneously communicating the fixed and mutable views to a remote site.

BRIEF DESCRIPTIONS OF THE DRAWINGS

The accompanying drawings, which are incorporated herein and constitute part of this specification, illustrate exemplary embodiments of the invention, and, together with the description given above, serve to explain the features of the invention.

DETAILED DESCRIPTION

A preferred mounting arrangement in the surveillance of area to be monitored includes a preferably fixed surveillance device capable of visual, audio, thermal, electrical surveying, imaging and/or recording over a fixed field of view and a movable surveillance device with zoom capability for visual, audio, thermal, electrical surveying, imaging and/or recording of a portion of the field of view such that simultaneous operation of the fixed and the movable surveillance devices eliminates or substantially minimizes the period that any portion of the area under surveillance is unmonitored, i.e., has a dead space. Surveillance devices can include sensors, audio recording and imaging equipment, and preferably includes cameras capable of analog, digital, thermal, and/or infrared imaging and/or recording of images. A preferred movable surveillance device includes a pan, tilt and zoom camera ("PTZ camera") capable of moving and preferably rotating the field of view of the camera over at least two axes or rotation so as to define the direction of pan and tilt.

Figure 1:
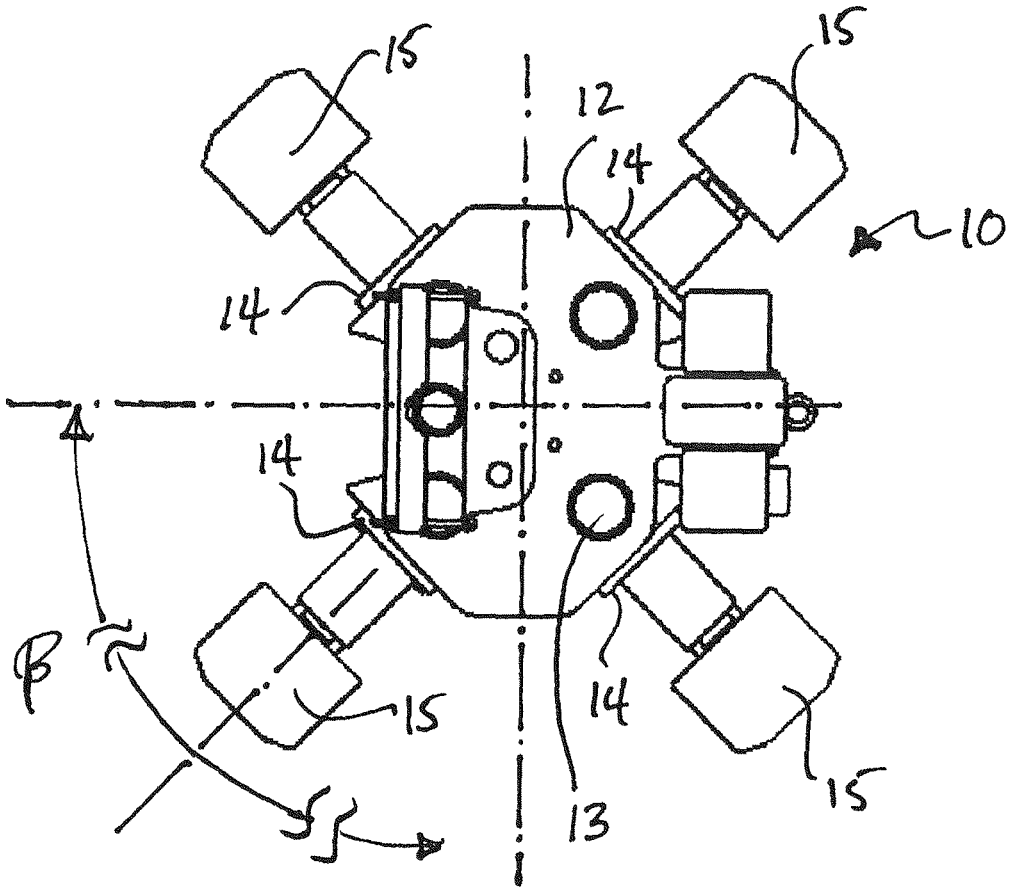
FIG. 1 is a top view of a preferred surveillance system apparatus.
Figure 2:
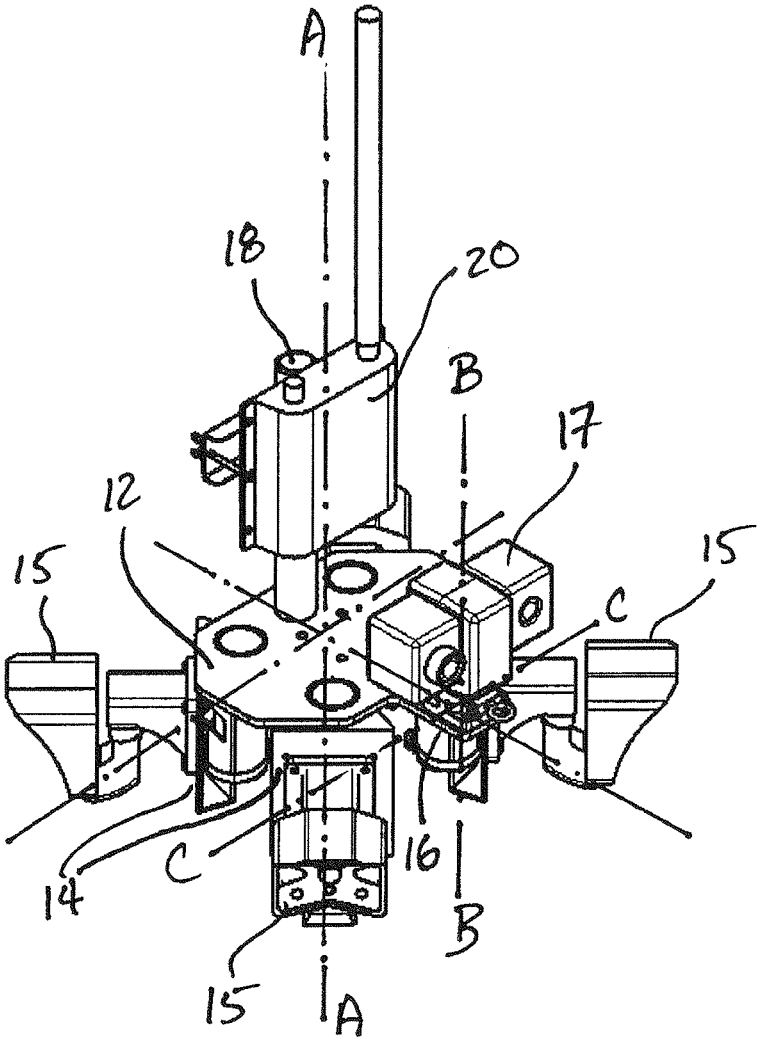
FIG. 2 is a perspective view of the apparatus of FIG. 1.
Figure 3:
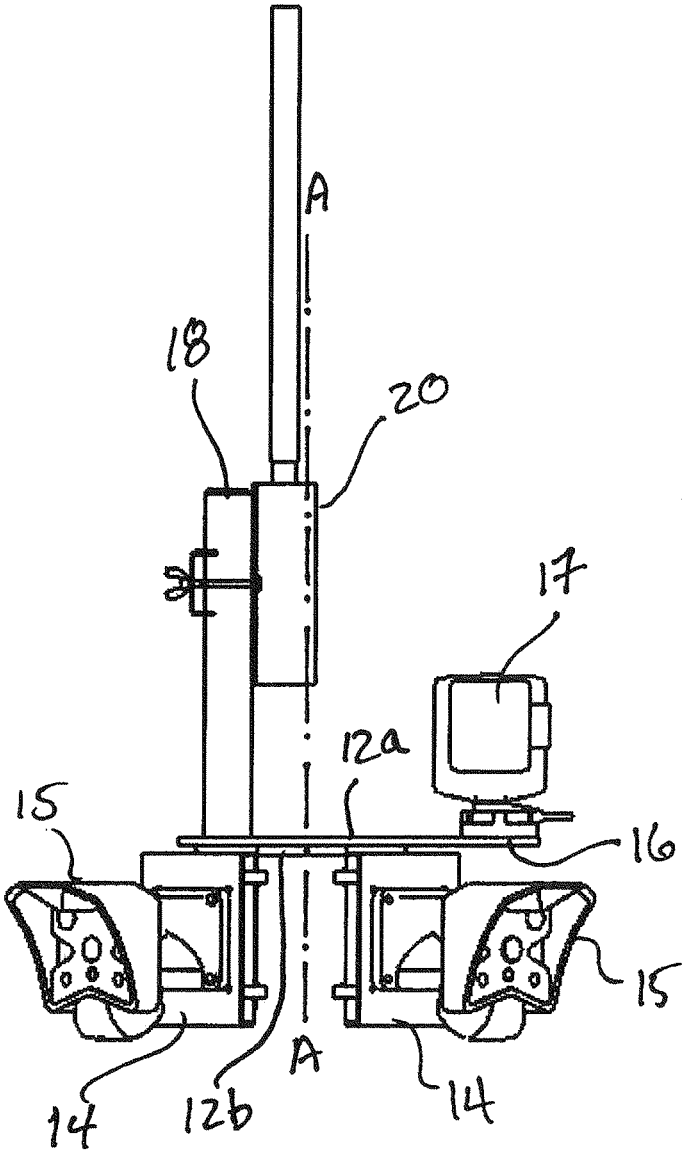
FIG. 3 is a side view of the apparatus of FIG. 1.

Referring to the FIGS. 1-3, in one embodiment of the surveillance system 10 is a frame assembly or apparatus that includes a mounting platform 12 that is preferably substantially a flat member having a first upper surface 12*a* and a second bottom surface 12*b*. The platform 12 is preferably symmetric in geometry defining a central axis A-A. One or more mounting brackets extend preferably from each of the upper and bottom surface and/or a lateral edge of the platform to mount and support one or more surveillance devices.

In the exemplary embodiment of the apparatus in FIGS. 1-3, the platform 12 is preferably a reinforced aluminum ⅜ inch thick flat mount. In the plan view of FIG. 1, the preferred platform is substantially octagonal in shape defining a major axis and a minor axis. Preferably the minor axis is about 9 inches long with the major axis being 13⅞ inch wide. The platform 12 can define alternate geometries. Extending from the bottom surface 12*b* of the platform are two or more legs 14. For example, four 2×7 inch fixed reinforced aluminum legs 14 depend from the bottom surface of the platform 12 equiradially spaced about the central axis A-A. Preferably mounted to each leg 14 is a camera 15 having a fixed field of view, such as for example, a MOBOTIX™ camera. The platform 12 can include one or more through holes 13 through which any wiring or cable can extend for connecting the cameras 15 or other surveillance equipment. The fixed field of view for each camera 15 defines an angular range β over which the camera 15 can survey an area to be monitored. The angular range β can range from less than thirty degrees to 360°. More preferably for each camera, its field of view ranges from zero to ninety degrees (0°-90°). Accordingly, in the preferred apparatus 10 of FIGS. 1-3, the four fixed view cameras 15 are shown equiradially spaced about the axis A-A by about 90 degrees such that together the cameras 15 provide a fixed 360° field of view. The fixed view cameras 15 are preferably substantially equidistantly spaced from the platform 12. Alternatively, the cameras 15 can have varying spaced distances from the platform 12.

Preferably extending from the upper surface 12*a* of the platform 12 are a plurality of brackets which preferably include, for example, a 4 inch long by ⅜ inch thick extension arm 16 for preferably mounting a camera 17, such as for example, a PTZ camera at a radial distance from the central axis A-A. More preferably, the extension arm 16 extends laterally from an edge of the platform 12 to support the camera 17 such that the camera 17 is substantially located above and centered between two of the fixed field of view cameras 15. The extension arm 16 may be affixed to the platform 12 or alternatively may be formed integrally with the platform 12. The camera 17 is preferably mounted so as to pivot about a first axis B-B and pivot or tilt about at least a second axis C-C. In addition, the camera 17 includes a zoom capability so as to provide a mutable view preferably about the central axis A-A. Further preferably extending from the upper surface of the platform 12 is a 13 inch long by 1 inch wide fixed upright radio mounting neck 18, which can hold a radio 20 that can provide wireless mobile communications between the operator and the security system. For example, the radio can be a wireless bridge 20 mounted to the neck 18 for communication with or coupled to the cameras 15, 17 to provide real time wireless remote control of the cameras and continuous visual wireless feed from each of the cameras 15, 17. More preferably, the wireless radio 20 provides power to all of the surveillance devices mounted to the platform 12 in addition to transmitting control and imaging signals between the devices and, for example, a remote operating station. The radio 20 is preferably powered by Power-over-Ethernet using an appropriate cable, such as for example, a CAP-6 or Category 6 cable coupled to a power supply. Surveillance devices coupled to the radio 20 can be powered from the radio, thus the apparatus 10 can use a single cable to power all the surveillance devices on the platform. In addition, the preferred Power-over-Ethernet cable can be used to carry data to and from the surveillance devices via the radio 20 along with any wireless broadcasts. With the wireless capabilities of the apparatus 10, remote access can be a fixed location or a mobile vehicle with onboard electronics. Accordingly, the preferred embodiment of the apparatus 10 is embodied as a Wireless Industrial Surveillance System Apparatus Mount (WISSAM).

The arrangement disclosed may be both a portable and permanent mounting system. The frame assembly can be designed to mount on a telescopic mast platform or vehicle that can be ground based or mobile. In one exemplary operation of the surveillance system 10, the fixed field view cameras 15 establish a fixed 360° view of an area being monitored by a remotely located operator. Once an object has been detected by one of the cameras of the apparatus 10, an operator can have the ability to lock-in on that object and view the object with the movable camera 17 by performing any one of a pan, tilt and/or zoom with the preferably PTZ camera, in either infrared or thermal imaging mode without compromising any of the fixed 360 degree view established by the other cameras 15. Accordingly, the preferred surveillance system provides a mounting apparatus that can continuously maintain the preferably 360 degree fixed field of view of the area being monitored, yet provide a mutable partial or detailed view of the area. The mutable view may be selected by an operator or alternatively be automatically changed. The number or fixed view cameras can be reduced or increased to provide the preferred fixed 360 degree view; and each camera can be configured so as to provide a total field of view that is less than 360 degrees. In view of the system capabilities, the preferred surveillance apparatus and operation allow the operator to fully secure any area be it a fence line or larger facility.

A preferred WISSAM itself can be fabricated, for example, using a ⅜ inch thick×9 inches long×13⅞ inches flat reinforced aluminum mount. Welded to the ⅜ inch flat mount, can be four 2 inches×7 inches fixed reinforced aluminum legs. The PTZ fixed mount can be a 4 inches long by ⅜ inch thick aluminum arm which may be attached to the mount above the legs for stability. Welded upright to the base of the mount can be a 13 inches long by 1 inch wide radio mounting neck, which can hold a radio that can provide wireless mobile communications between the operator and the security system. The WISSAM can be designed to rest on top of a 6 to 100 foot pole tower or vehicle. Once mounted, the cameras can provide an elevated fixed 360 degree view of the designated area. The cameras may record all angles, either in infrared or thermal imaging. Both visual as well as audio recordings may be wirelessly streamed to the operator's computer system.

To make the preferred assembly frame, one can provide the aluminum, including (numerous) metal polls, and utilize suitable a machine that can stencil groves and holes for the WISSAM frame. The exact measurements and stenciling can be generated from a computer graphic engineered software program. The completed WISSAM can then be powered coated to meet any color of preference. The components can be connected using any suitable fastener, e.g., screws, bolts, clamps, and/or adhesives to produce the WISSAM as shown in the drawing. Consumers can use the WISSAM by mounting the cameras of their choice for the fixed 360 array viewing, mounting the PTZ camera, which can operate full pan, tilt, and zoom features; and mounting the WISSAM on a tower or pole of choice. The WISSAM frame can be alternatively fabricated for alternative mounting, for example, for mounting on a cell tower.

While the present invention has been disclosed with reference to certain embodiments, numerous modifications, alterations, and changes to the described embodiments are possible without departing from the sphere and scope of the present invention. Accordingly, it is intended that the present invention not be limited to the described embodiments, but that it has the full scope defined by the language of the following claims, and equivalents thereof.

What is claimed is:

1. An apparatus comprising:

a mount;

a first camera attached to the mount and configured to provide a fixed view of a designated area;

at least a second camera attached to the mount to provide a mutable view; and a plurality of sensors attached to the mount to make visual and audio recordings of the fixed and mutable views for continuous wireless streaming of the views, wherein the mount is a substantially planar member having an upper surface a lower surface, the mount further includes a leg extending from the lower surface of the planar member, the first camera being mounted to the leg so as to be spaced from the planar member, the mount including an extension arm, the at least second camera being mounted on the extension arm so as to be located above the first camera.

2. The apparatus of claim 1, wherein the first camera includes a plurality of cameras, each camera having a fixed field of view over an angular range between 0-90 degrees.

3. The apparatus of claim 2, wherein the fixed view defines an angular view of 360 degrees about the mount.

4. The apparatus of claim 1, wherein the plurality of sensors include a radio coupled to a power supply using Power-over-Ethernet.

5. The apparatus of claim 1, wherein the planar member has a substantially hexagonal geometry.

6. An apparatus for surveillance of an area, the apparatus comprising:

a platform defining a central axis;

a plurality of fixed field of view cameras mounted to the platform and equiradially spaced about the central axis, each of the plurality of cameras having a fixed field of view over an angular range of about 90 degrees about the central axis;

at least one pivotable camera mounted to the platform and radially spaced from the central axis providing a mutable view about the central axis; and a communications device coupled to the fixed field and pivotable cameras so as to provide a continuous fixed field view of the area and a mutable view of the area, wherein the platform is a substantially planar member having an upper surface a lower surface, the platform further includes a plurality of legs extending from the lower surface of the planar member, each of the fixed field view cameras being mounted to one of the plurality of legs so as to be equidistantly spaced from the planar member, the platform including an extension arm, the at least one pivotable camera being mounted on the extension arm so as to be located above and between two of the plurality of fixed field view cameras.

7. The apparatus of claim 6, wherein the at least one pivotable camera pivots about two axes of rotation.

8. The apparatus of claim 7, wherein the at least one pivotable camera can pan, tilt or zoom to a location of the area in the field of view.

9. The apparatus of claim 6, wherein the communications device includes a radio coupled to a power supply using Power-over-Ethernet.

10. An apparatus for surveillance of an area, the apparatus comprising:

a platform defining a central axis;

a plurality of fixed field of view cameras mounted to the platform and equiradially spaced about the central axis, each of the plurality of cameras having a fixed field of view over an angular range of about 90 degrees about the central axis such that the plurality of cameras define a fixed field of view of the area of 360 degrees about the central axis;

at least one pivotable camera mounted to the platform and radially spaced from the central axis providing a mutable view about the central axis; and a communications device coupled to the fixed field and pivotable cameras so as to provide a continuous fixed field view of the area and a mutable view of the area, wherein the platform is a substantially planar member having an upper surface a lower surface and a substantially hexagonal geometry, the platform further includes a plurality of legs extending from the lower surface of the planar member, each of the fixed field view cameras being mounted to one of the plurality of legs so as to be equidistantly spaced from the planar member, the platform including an extension arm, the at least one pivotable camera being mounted on the extension arm so as to be located above and between two of the plurality of fixed field view cameras.

11. The apparatus of claim 1, wherein the mount includes an extension arm, the second camera being mounted on the extension arm.

12. The apparatus of claim 6, wherein the planar member has a substantially hexagonal geometry.

* * * * *